US010519772B2

(12) United States Patent
Simon

(10) Patent No.: US 10,519,772 B2
(45) Date of Patent: Dec. 31, 2019

(54) CONSTRUCTION ELEMENT FOR CREATING A TUNNEL, TUNNEL COMPRISING SUCH AN ELEMENT AND METHODS FOR CONSTRUCTING SUCH AN ELEMENT AND SUCH A TUNNEL

(71) Applicants: AGENCE NATIONALE POUR LA GESTION DES DECHETS RADIOACTIFS, Châtenay-Malabry (FR); CONSTRUCTIONS MÉCANIQUES CONSULTANTS, Vaulnaveys-le-Haut (FR)

(72) Inventor: Jean Simon, Vaulnaveys le Haut (FR)

(73) Assignees: AGENCE NATIONALE POUR LA GESTION DES DECHETS RADIOACTIFS, Châtenay-Malabry (FR); CONSTRUCTIONS MÉCANIQUES CONSULTANTS, Vaulnaveys-le-Haut (FR)

( * ) Notice: Subject to any disclaimer, the term of this patent is extended or adjusted under 35 U.S.C. 154(b) by 0 days.

(21) Appl. No.: 15/564,087

(22) PCT Filed: Apr. 4, 2016

(86) PCT No.: PCT/FR2016/050764
§ 371 (c)(1),
(2) Date: Oct. 3, 2017

(87) PCT Pub. No.: WO2016/156763
PCT Pub. Date: Oct. 6, 2016

(65) Prior Publication Data

US 2018/0163540 A1 Jun. 14, 2018

(30) Foreign Application Priority Data

Apr. 3, 2015 (FR) ..... 15 52934

(51) Int. Cl.
*E21D 11/05* (2006.01)
*E21D 11/04* (2006.01)

(52) U.S. Cl.
CPC ..... *E21D 11/04* (2013.01); *E21D 11/05* (2013.01)

(58) Field of Classification Search
CPC ..... E21D 11/04; E21D 11/05; E21D 11/08; E21D 11/086

(Continued)

(56) References Cited

U.S. PATENT DOCUMENTS 3,545,213 A * 12/1970 Hofbauer ..... E21D 11/04 138/105
4,075,855 A * 2/1978 Meldner ..... E21D 11/083 405/152

(Continued)

FOREIGN PATENT DOCUMENTS

CA 2949647 A1 * 11/2015 ..... E21D 11/05
DE 3738818 A1 5/1989

(Continued)

OTHER PUBLICATIONS

Jul. 6, 2016 International Search Report issued in International Patent Application No. PCT/FR2016/050764.

*Primary Examiner* — Frederick L Lagman
(74) *Attorney, Agent, or Firm* — Oliff PLC

(57) ABSTRACT

Construction element for creating a tunnel, including an incompressible concrete first layer and a compressible second layer securedly united to the first layer to form a monoblock prefabricated construction element to be integrated in a section of the tunnel, the second layer including a material comprising granulates aggregated by a binder, and cavities sunk into the material.

10 Claims, 9 Drawing Sheets

(58) Field of Classification Search
USPC ..... 405/150.1, 151
See application file for complete search history.

(56) References Cited

U.S. PATENT DOCUMENTS

| | | | | |
|---|---|---|---|---|
| 4,363,565 | A | 12/1982 | MacKenzie | |
| 4,890,956 | A * | 1/1990 | Hahn | B65G 5/00 405/150.1 |
| 5,439,319 | A * | 8/1995 | Flanagan | E21D 11/383 156/287 |
| 6,170,531 | B1 * | 1/2001 | Jung | E03F 3/06 138/97 |
| 6,302,621 | B1 * | 10/2001 | Miya | E02B 11/005 405/127 |
| 6,761,504 | B1 * | 7/2004 | Brandenberger | E21D 11/383 405/150.1 |
| 8,978,708 | B2 * | 3/2015 | Brandenburger | F16L 55/1656 138/97 |
| 2017/0167261 | A1 * | 6/2017 | Simon | E21D 11/08 |

FOREIGN PATENT DOCUMENTS

| | | | | |
|---|---|---|---|---|
| EP | 1925775 | A1 * | 5/2008 | E21D 11/05 |
| FR | 1200989 | A | 12/1959 | |
| FR | 2988770 | * | 10/2013 | E21D 23/03 |
| GB | 2 013 757 | A | 8/1979 | |
| WO | WO-2006034675 | A1 * | 4/2006 | E04C 5/01 |
| WO | 2013/150191 | A2 | 10/2013 | |

* cited by examiner

CONSTRUCTION ELEMENT FOR CREATING A TUNNEL, TUNNEL COMPRISING SUCH AN ELEMENT AND METHODS FOR CONSTRUCTING SUCH AN ELEMENT AND SUCH A TUNNEL

BACKGROUND OF THE INVENTION

The invention relates to the creation of tunnels, in particular underground tunnels, and to the construction elements of such tunnels.

STATE OF THE ART

In the field of tunnels, a cavity is in general excavated underground, and a tunnel is then formed in this cavity using voussoirs. The voussoirs correspond to elements constituting an annular section of the tunnel once assembled to one another. When the cavity is excavated in a ground, the equilibrium of the ground is modified and the latter exerts more or less intense thrusts which tend to close the cavity thus formed, this phenomenon being called "ground convergence".

French Patent application FR1200989 can be cited which discloses a ground convergence damping system comprising a coating covering an outer wall of a tunnel and which comprises devices each provided with a pass-through hole. These devices with a pass-through hole create a free space within the coating, referred to as residual volume, which participates in particular in damping the ground convergence. In particular, the thrust of the ground tends to occupy the residual volume, i.e. the volume left unoccupied by the devices, which enables the thrust to be dampened. But to achieve the coating, the devices have to be injected in a space delineated between the outer wall of the tunnel and the inner surface of the ground. However, when construction of the tunnel is performed, ground elements may agglutinate in the delineated space and hamper injection of the devices, which may prevent the devices from being arranged in homogenous manner around the outer wall of the tunnel.

British Patent application GB2013757 and American Patent U.S. Pat. No. 4,363,565 can also be cited which disclose a method for creating a tunnel from prefabricated concrete voussoirs. Before being used for creating the tunnel, each prefabricated concrete voussoir comprises a layer of compressible material, such as a polyethylene foam, stuck onto the outer surface of the voussoir. But the foam can be damaged when the voussoir is stored or transported, which may result in a loss of its mechanical compression and deformation properties. Furthermore, it is difficult to stick the foam to bind it to the voussoir.

It is therefore advantageous to provide a construction element suitable for the creation of tunnels, and a tunnel constructed from such an element, and in particular to provide methods for constructing such an element and such a tunnel.

OBJECT OF THE INVENTION

One object of the invention consists in palliating the shortcomings set out above and in particular in providing means that are easy to achieve and to implement to dampen the ground convergence exerted on a tunnel.

Another object of the invention is to provide a means for guaranteeing the damping properties of the mechanical ground convergence of a construction element during storage or transportation of the latter.

According to one feature, a construction element is proposed for creation of a tunnel, comprising an incompressible first layer made from concrete and a compressible second layer securedly united to the first layer to form a monoblock prefabricated construction element configured to be integrated in a section of the tunnel.

The second layer comprises a material comprising granulates aggregated by a binder, and cavities sunk into the material.

A prefabricated construction element suitable for creating a section of a tunnel is thus provided. Such a monoblock construction element is easy to handle and manufacturing thereof can be monitored so as to obtain a homogenous tunnel section, in order to master the behaviour of the tunnel as regards ground convergence. Furthermore, the cavities formed in the material determine the compressibility of the second layer. In other words the cavities enable the ground to converge and to relax the stresses exerted on the first layer. Furthermore, as the cavities are sunk into the material, they are protected during storage of the construction element so that the construction element preserves its compressibility properties when used in a tunnel section.

The binder can comprise a cement.

Aggregation of the granulates with cement enables a mortar to be obtained as material of the second layer. Mortar is particularly suitable to bind with the concrete first layer, while at the same time enabling the ground to converge and to relax the stresses exerted on the first layer. It is then not necessary to use an adhesive film to secure the two layers of the monoblock prefabricated elements to one another. Mortar is moreover shock resistant and enables the cavities of the second layer to be protected when transportation of the construction element takes place, while at the same time preserving the mechanical compressibility and deformation properties of the construction element.

The second layer can comprise a plurality of devices sunk into the material, each device having a solid body delineating at least one closed free space.

The solid body of the devices can be made from ceramic or from plastic.

The second layer can comprise a plurality of pieces sunk into the material, each piece having a porous solid body provided with several pass-through holes and several closed free spaces.

The second layer can also comprise a compound generating a gas in the material forming the cavities.

According to another feature, a tunnel is proposed situated inside a cavity excavated in a ground, at least one section of the tunnel being formed from at least one two-layer construction element as defined in the foregoing.

According to another feature, a method for producing a construction element for creating a tunnel is proposed, comprising the following steps:

- making an incompressible first layer of concrete; and
- making a compressible second layer securedly united to the first layer to form a monoblock prefabricated construction element configured to be integrated in a section of the tunnel.

In this method, the second layer is made from a material comprising granulates aggregated by a binder, and cavities sunk into the material.

Devices each having a solid body delineating at least one closed free space can be sunk into the material.

The cavities can also be formed by injection of a gas into the material.

According to another feature, a method for constructing a tunnel is proposed comprising the following steps:

forming a cavity in a ground by means of a tunnel boring machine; and forming sections of the tunnel situated inside the cavity, at least one section being made from at least one two-layer construction element as defined in the foregoing as the tunnel boring machine progressively advances.

BRIEF DESCRIPTION OF THE DRAWINGS

Other advantages and features will become more clearly apparent from the following description of particular embodiments and implementations of the invention given for non-restrictive example purposes only and represented in the appended drawings, in which.

DETAILED DESCRIPTION

In general manner, although the present invention procures particular advantages in the field of tunnels, it is also applicable to any system which is created in an underground cavity and which is configured to resist ground convergence, for example partially or totally buried receptacles or tanks.

Figure 1:
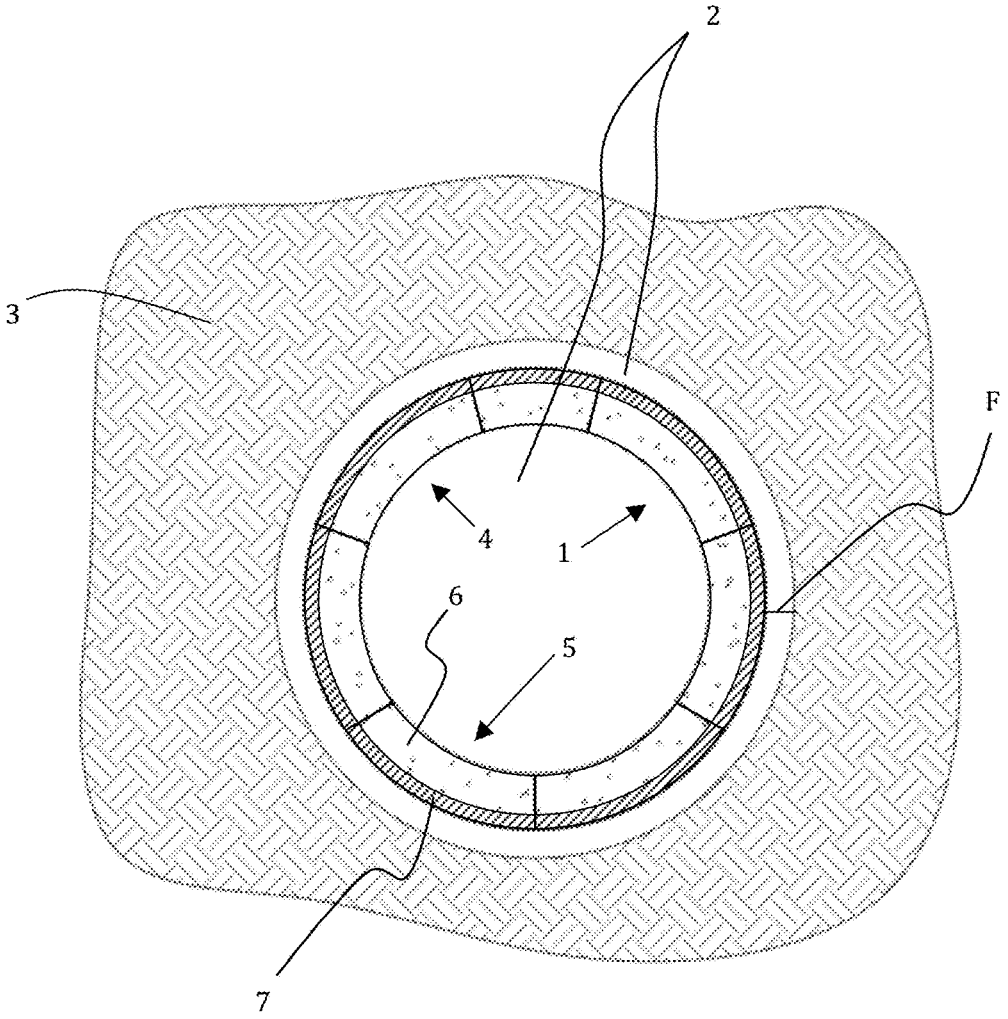
FIG. 1 schematically represents a cross-sectional view of an embodiment of a tunnel according to the invention.
Figure 2:
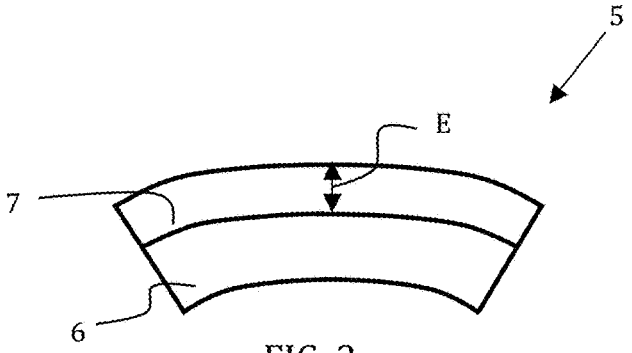
FIG. 2 schematically illustrates an embodiment of a construction element according to the invention.

In FIG. 1, a tunnel 1 made in a cavity 2 excavated in a ground 3 has been represented, in other words an underground tunnel. The tunnel 1 can be open and be reverse U-shaped, and can also be closed and can have an ovoid shape or any other shape. Preferentially, the tunnel 1 has a globally tubular shape. The tunnel 1 comprises sections 4 situated within the cavity 2. At least one section 4, and preferably each section 4, is made from construction elements 5 assembled to one another. At least one construction element 5 comprises an incompressible first layer 6 made from concrete. For example, when the sections 4 of the tunnel 1 have an annular shape, the first layer 6 has the shape of a curved hexahedron. The construction element 5 further comprises a compressible second layer 7 securedly united to the first layer 6 to form a prefabricated construction element 5 of monoblock type, as illustrated in FIG. 2. As the second layer 7 is securedly united to the first layer 6, it snugly follows the shape of the first layer 6. The construction element 5 is thus configured to be integrated in a section 4 of the tunnel 1. When the first and second layers 6, 7 are in the shape of a curved hexahedron, the construction element 5 then forms a voussoir with a compressible part 7. The construction element 5 is prefabricated, i.e. it is made before the tunnel 1 is created. In other words, the construction element 5 is created beforehand, and several construction elements 5 are then assembled to one another so as to form a section 4 of the tunnel 1. The necessity of forming a damping coating by injection of material between a voussoir and the ground 3 is thereby avoided. The construction element 5 does in fact previously incorporate a compressible layer 7 and therefore has an integrated mechanical damping property. Furthermore, what is meant by monoblock element is a movable element which keeps its physical integrity and its mechanical properties when transported, for example when the element is moved from its manufacturing area to the location of the section 4 of the tunnel 1 where it is placed. In other words, the construction element 5 is configured to be integrated in a section 4 of the tunnel 1, and in particular in a section 4 which is being created.

Different embodiments of the construction element 5 have been illustrated in FIGS. 3 to 8. In general manner, the second layer 7 comprises a material 11 comprising granulates aggregated by a binder and cavities 51 to 55 sunk in the material. The binder makes the granulates agglomerate to obtain a compact material 11. The compact material 11 in particular gives the second layer 7 mechanical strength properties. The cavities 51 to 55 for their part enable the second layer 7 to be made compressible, i.e. the thickness E of the second layer 7 can decrease when ground convergence 3 takes place.

In the initial state, the ground 3 exerts an initial convergence pressure on the tunnel 1. On account of the movements of the ground 3, the latter will tend to converge towards the inside of the cavity 2. This convergence of the ground 3 will increase the pressure exerted on the second layer 7. Under the effect of this pressure increase, the material 11 will take the place of the cavities 51 to 55, and the second layer 7 will be deformed. Deformation of the compressible second layer 7 will thus enable the ground 3 to move progressively towards the inside of the tunnel 1, until the ground 3 occupies a state of equilibrium. In the state of equilibrium, the convergence pressure is lower than the initial pressure. The compressible second layer 7 therefore enables the convergence of the ground 3 to be dampened until a state of equilibrium is achieved for which the convergence pressure is supported by the construction element 5, i.e. the incompressible first layer 6 does not deform under the convergence pressure at equilibrium The thickness E of the second layer 7 is chosen according to the damping of the convergence of the ground 3 that it is desired to be obtained. In particular the thickness E is chosen according to the displacement of the ground 3, with respect to its initial position, which can be supported by the construction element 5. In the initial position, the ground 3 is at an initial distance F, as illustrated in FIG. 1, from the outer surface of the second layer 7. The initial distance F corresponds to the thickness of the free space F. Furthermore, the thickness E also depends on the compressibility of the second layer 7.

More particularly, aggregation of the granulates by a binder enables a solid material 11 to be obtained which can provide a resistance force opposing the stresses exerted by the ground 3 when convergence of the latter takes place. The material 11 is also suitable for protecting the cavities 51 to 55 in the event of shocks occurring during transportation of the construction element 5 to integrate it in a section 4 of the tunnel 1, and to preserve the compressibility properties of the second layer 7. The granulates can be sand or gravel or a mixture of the two. The binder enables aggregation of the granulates, and can be cement, plaster, lime, bitumen, clay, or a plastic material such as for example a synthetic resin. In optional manner, the material 11 can comprise one or more adjuvants to give the material 11 specific properties.

A mortar is preferably used as material 11 of the second layer 7, made from a mixture of fine granulates, for example sand, cement and water. Advantageously, the fine granulates have a diameter of less than 4 mm to improve the deformation of the second layer 7. Cement mixed with water forms a paste which hardens progressively following chemical reactions between the cement and the water. Mortar is particularly suitable as it easily adheres to the first layer 6 of incompressible concrete, which facilitates manufacturing of the construction element 5. It is in fact not necessary to use a specific adhesive to bind the two layers 6, 7 of the element 5 to one another. In advantageous manner, the mortar comprises an air-entraining adjuvant to cause formation of microbubbles of air in the material 11. Lignosulfonates or resin abietates can for example be used as air-entraining adjuvant.

Unlike the material 11 of the second layer 7, the incompressible first layer 6 is made from concrete. What is meant by concrete is a material obtained by a mixture of thick granulates, i.e. with a diameter comprised between 4 and 50 mm such as gravel, fine granulates with a diameter of less than 4 mm such as sand, cement, and water. The concrete of the first layer 6 is devoid of cavities and is therefore incompressible, i.e. it does not deform under a stress exerted by the convergence of the ground 3. The concrete is preferably reinforced. A reinforced concrete comprises metal rods for reinforcement of the first layer 6.

Figure 3:
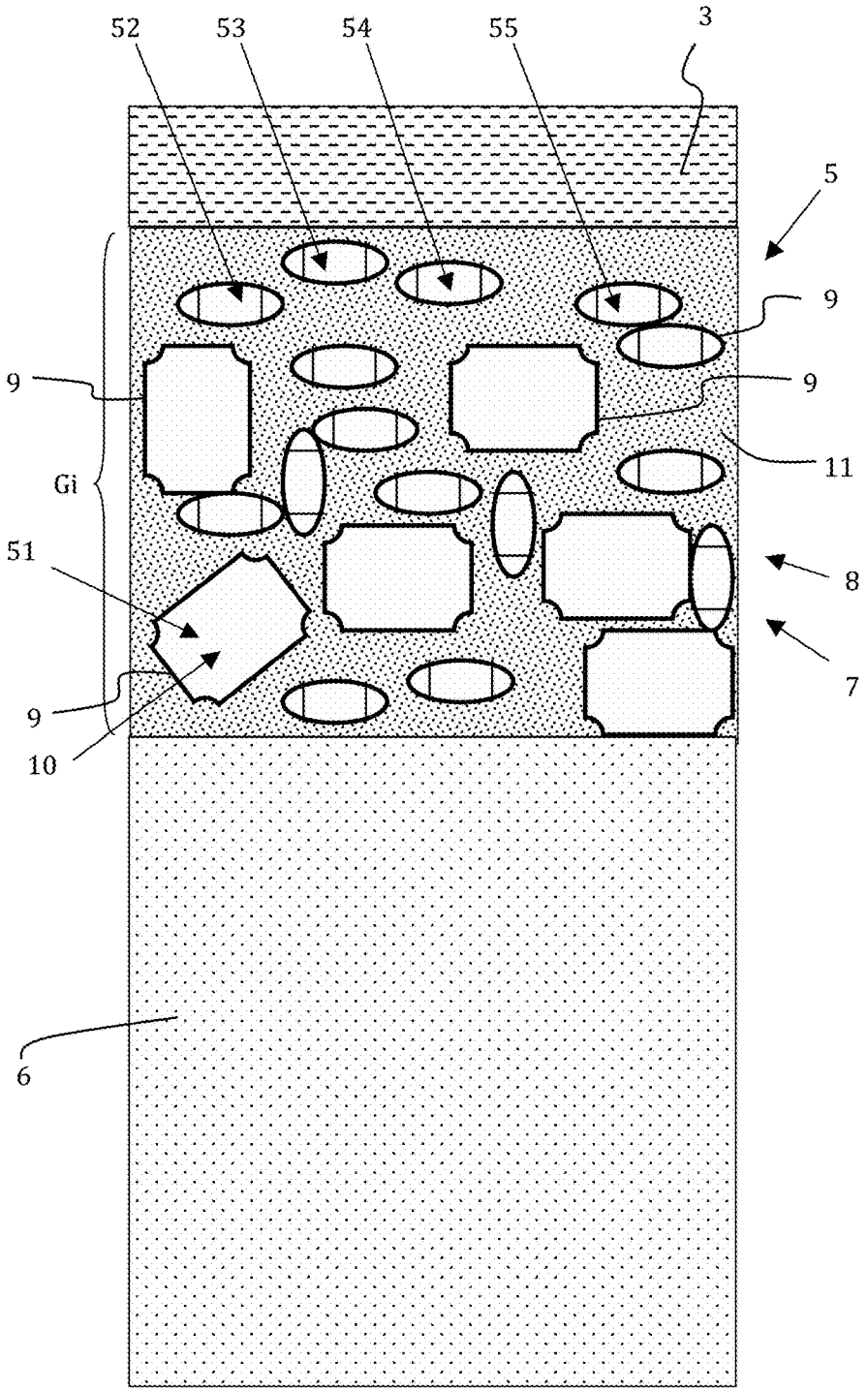
FIGS. 3, 5 and 7 schematically illustrate embodiments of a construction element integrated in a tunnel and in an initial state before ground convergence.
Figure 4:
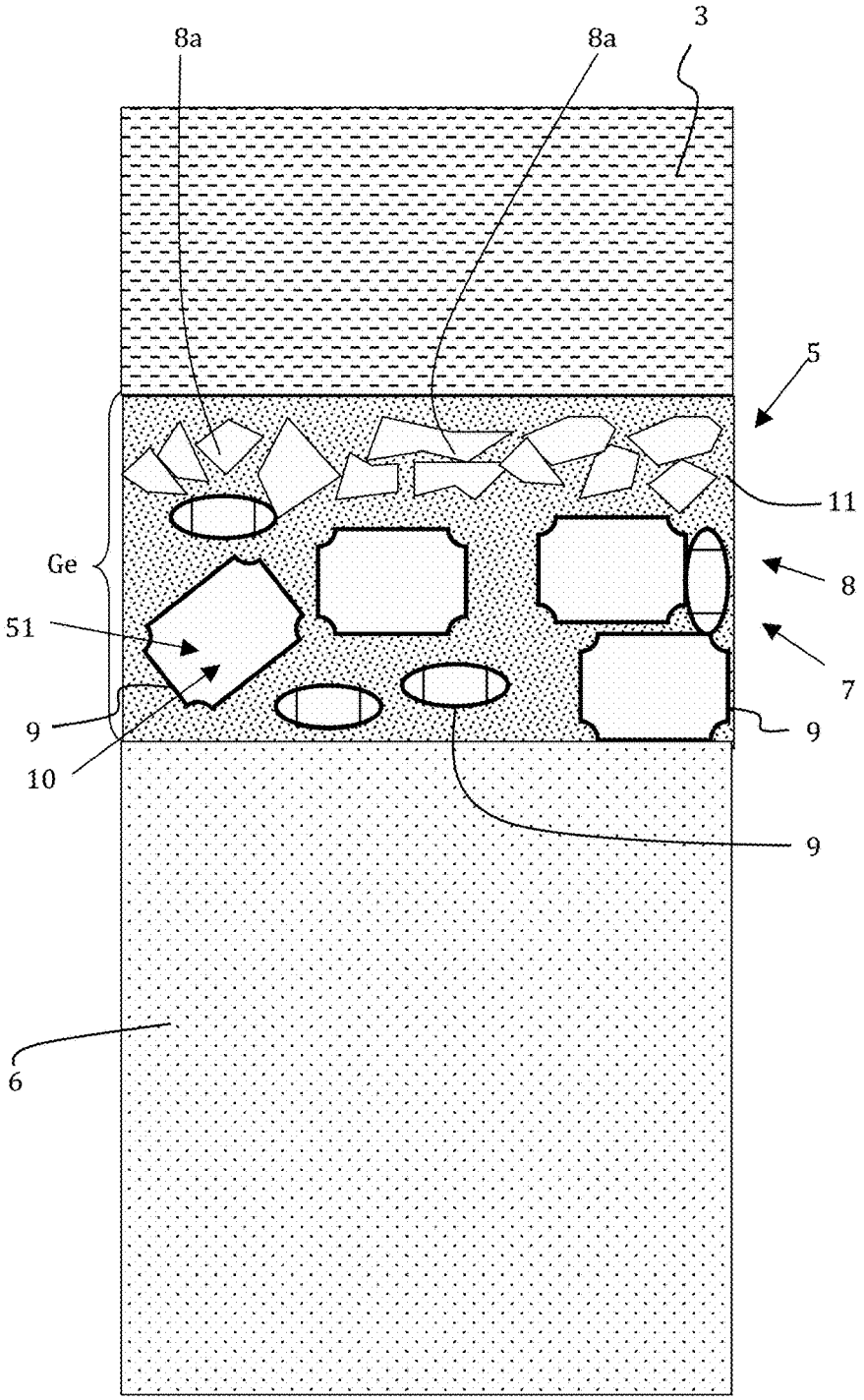
FIGS. 4, 6 and 8 respectively schematically illustrate the embodiments of FIGS. 3, 5 and 7 in an equilibrium state after ground convergence.
Figure 9:
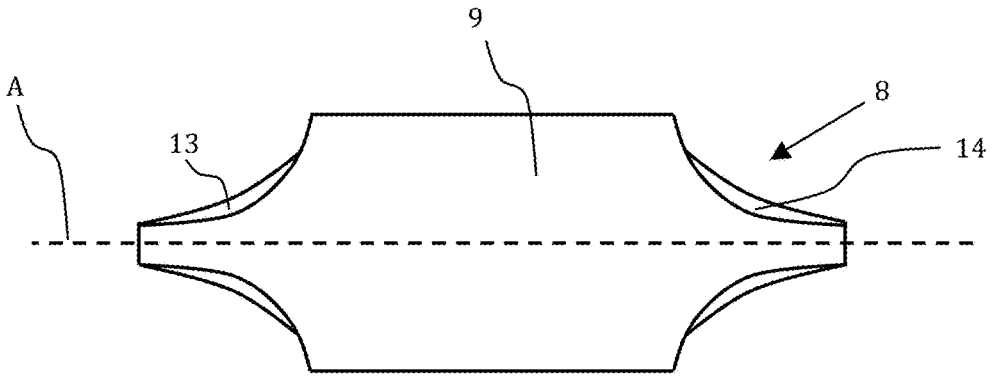
FIG. 9 schematically illustrates a perspective view of an embodiment of the device provided with a closed cavity.
Figure 10:
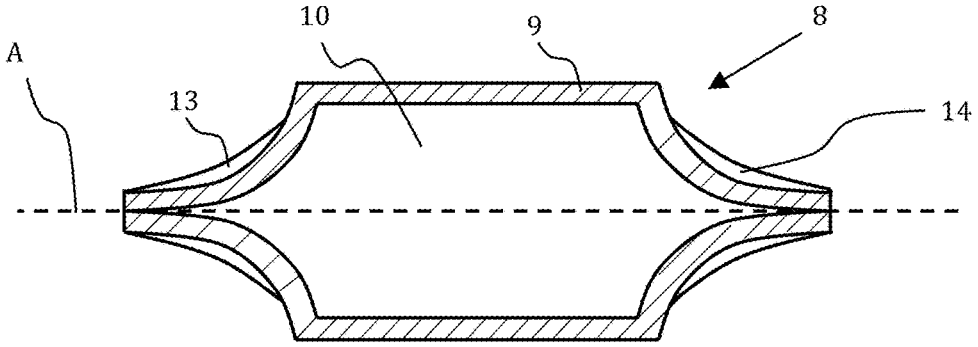
FIG. 10 schematically illustrates a cross-sectional view of the device of FIG. 9.
Figure 11:
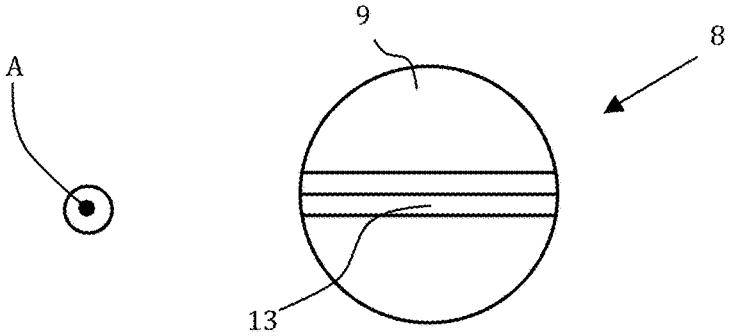
FIG. 11 schematically illustrates a left-side front view of the device of FIG. 9.

In FIGS. 3 and 4, a preferred embodiment has been represented in which the second layer 7 comprises a plurality of devices 8 each having a solid body 9 delineating at least one closed free space 10, as illustrated in FIGS. 9 to 11. More particularly, the devices 8 are sunk in the material 11 of the second layer 7, in other words the second layer 7 does not present any gaps between the devices 8. In this case, each closed free space 10 forms a cavity 51 to 55 sunk in the heart of the material 11. A homogenous second layer 7 is thus obtained the compressibility of which is mastered. Such devices 8 are also illustrated in FIGS. 9 to 11. An initial state in which the ground 3 is in contact with the second layer 7 of the construction elements 5 before convergence is represented in FIG. 3. In the initial state, the bodies of the devices 8 have an initial shape and the second layer 7 has an initial thickness Gi. When the ground 3 converges, as illustrated in FIG. 4, the compressible second layer 7 deforms and enables displacement the ground 3 towards the centre of the tunnel 1. The ground 3 can break or deform the devices 8, until a state of equilibrium is reached in which the ground 3 is at an equilibrium distance Ge from the outer surface of the first layer 6, as illustrated in FIG. 4. The equilibrium distance Ge is smaller than the initial distance Gi. The breaking strength of the devices 8 is lower than the convergence pressure of the ground 3 so as to allow crushing of the devices 8. Broken devices have been represented by the reference numeral 8*a*. In other words, all or some of the devices 8 can comprise a state in which they are broken. This enables movements of the ground 3 to be absorbed without damaging the tunnel 1.

The solid bodies 9 of the devices 8 can be deformed, by breaking or by bending, in particular due to their closed free space 10, to enable deformation of the second layer 7. A compressible layer 7 is thus provided, having a residual volume formed by the sum of the closed free spaces of each of the devices 8, which provides a damping property of the convergence of the ground 3.

For example, the devices 8 can be made from ceramic. Ceramic provides a good strength while at the same time being breakable to efficiently dampen the convergence of the ground 3. When the bodies 9 of the devices 8 break, the ground 3 can converge towards the inside of the tunnel 1. The devices 8 can also be made from glass or from mortar which are, just like ceramic, materials which can be broken due to the effect of the convergence of the ground 3. As a variant, the devices 8 can be made from metal or from plastic. The devices 8 are all substantially identical in order to obtain a homogenous second layer 7.

Figure 5:
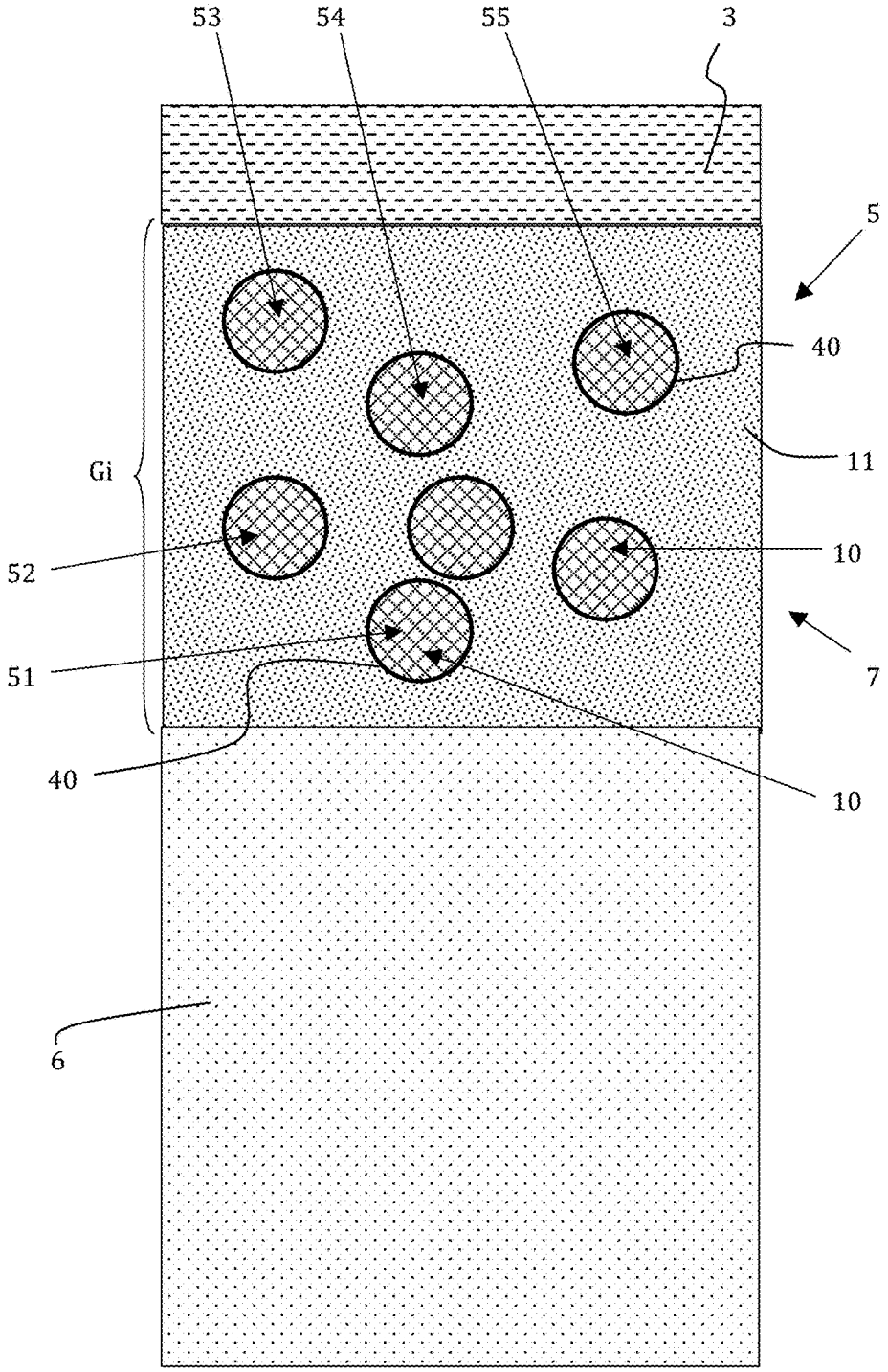
Figure 6:
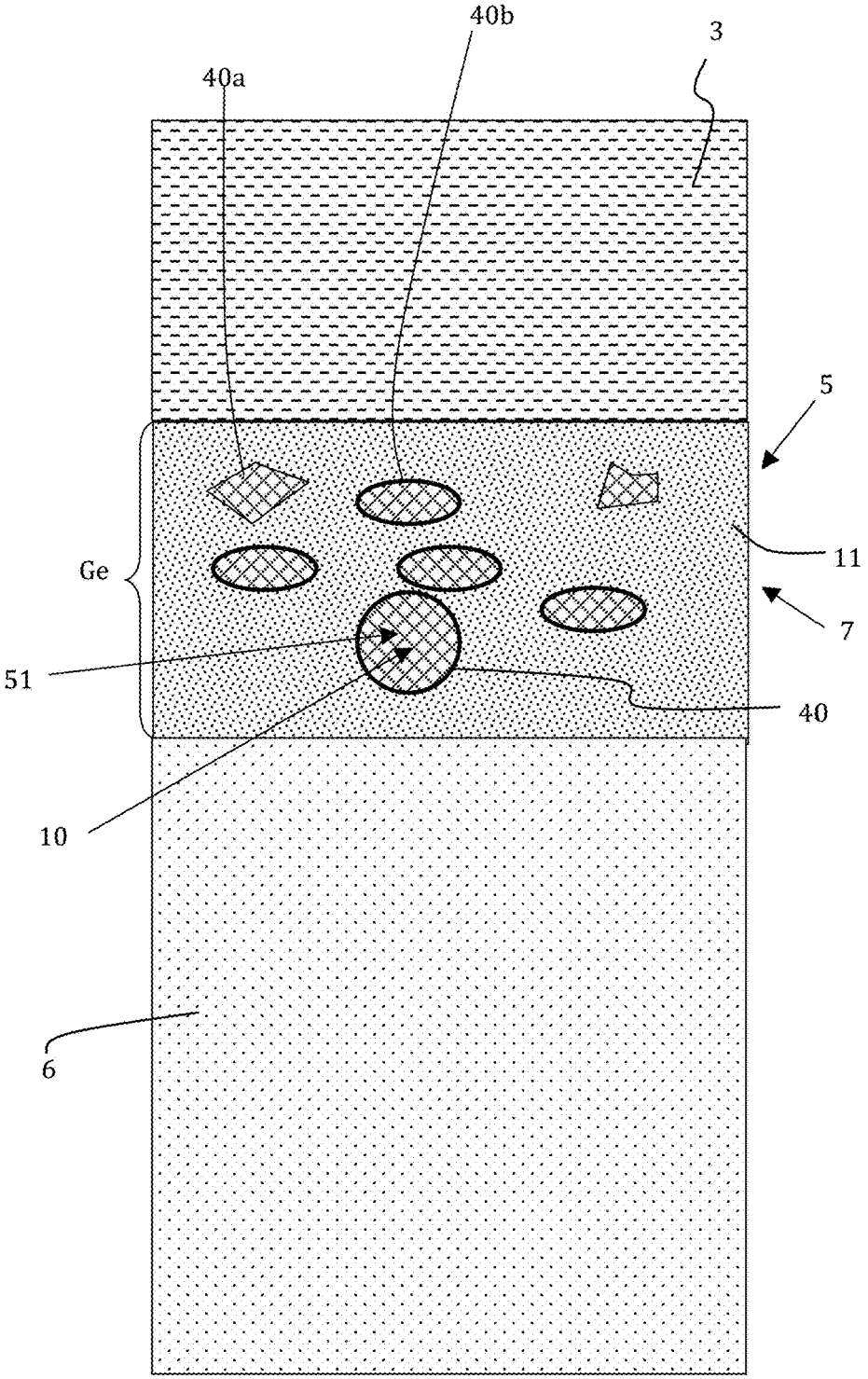

In FIGS. 5 and 6, another embodiment has been represented in which the second layer 7 comprises pieces 40 having a porous solid body provided with several pass-through holes and several closed free spaces 10. What is meant by pass-through holes are open channels or apertures at the surface of the solid body of the piece 40. Preferentially, the diameter of the pass-through holes is smaller than that of the granulates of the material 11. Also what is meant by closed free spaces 10 are empty spaces enclosed inside the piece 40. The pieces 40 can thus deform by breaking or bending. The body of the pieces 40 can be made from glass, plastic, or ceramic. For example, the pieces 40 are polystyrene balls. Preferably the pieces 40 are sunk in the material 11, i.e. the second layer 7 does not present any gaps between the pieces 40. An initial state in which the ground 3 is in contact with the second layer 7 of the construction elements 5 before convergence has been represented in FIG. 5. In the initial state, the pieces 40 have an initial shape and the second layer 7 has an initial thickness Gi. When the ground 3 converges, as illustrated in FIG. 6, the compressible second layer 7 deforms and enables displacement of the ground 3 towards the centre of the tunnel 1. The ground 3 can break or deform the pieces 40 until a state of equilibrium is reached in which the ground 3 is at an equilibrium distance Ge from the outer surface of the first layer 6. The equilibrium distance Ge is smaller than the initial distance Gi. The breaking strength of the pieces 40 is lower than the convergence pressure of the ground 3 so as to enable deformation of the pieces 40. Broken pieces have been represented by the reference numeral 40*a* and deformed pieces by the reference numeral 40*b*. In other words, all or some of the pieces 40 can comprise a state in which they are broken or deformed. This enables movements of the ground 3 to be absorbed without damaging the tunnel 1.

Figure 7:
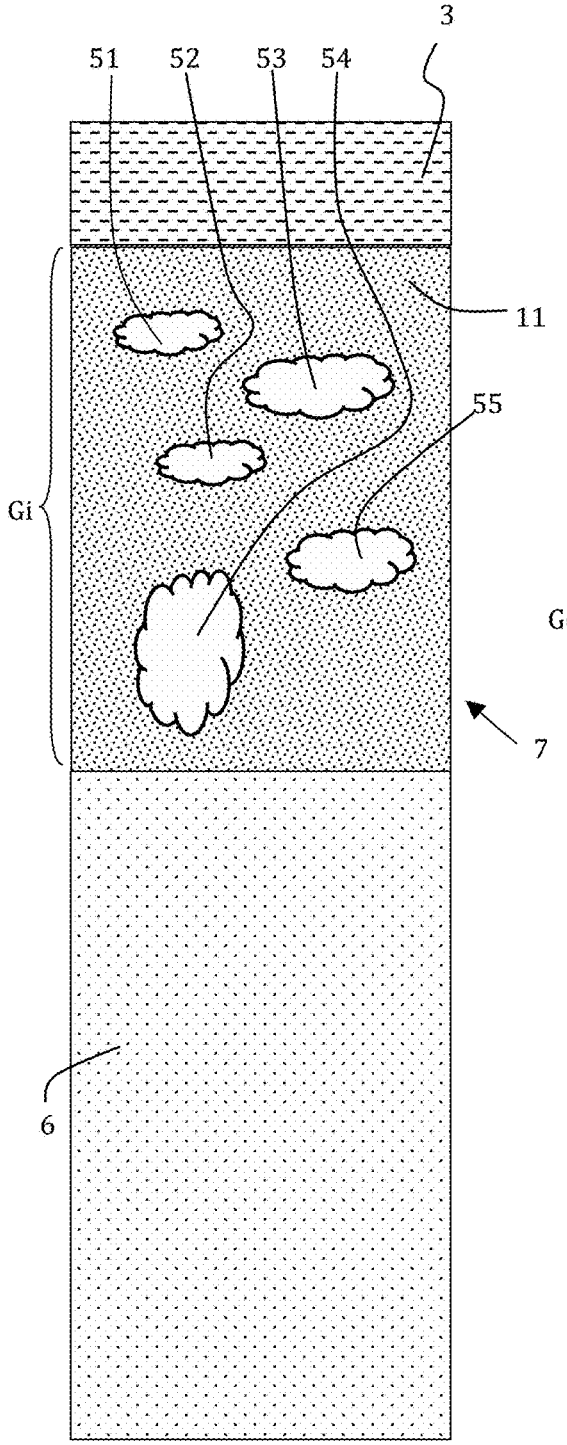
Figure 8:
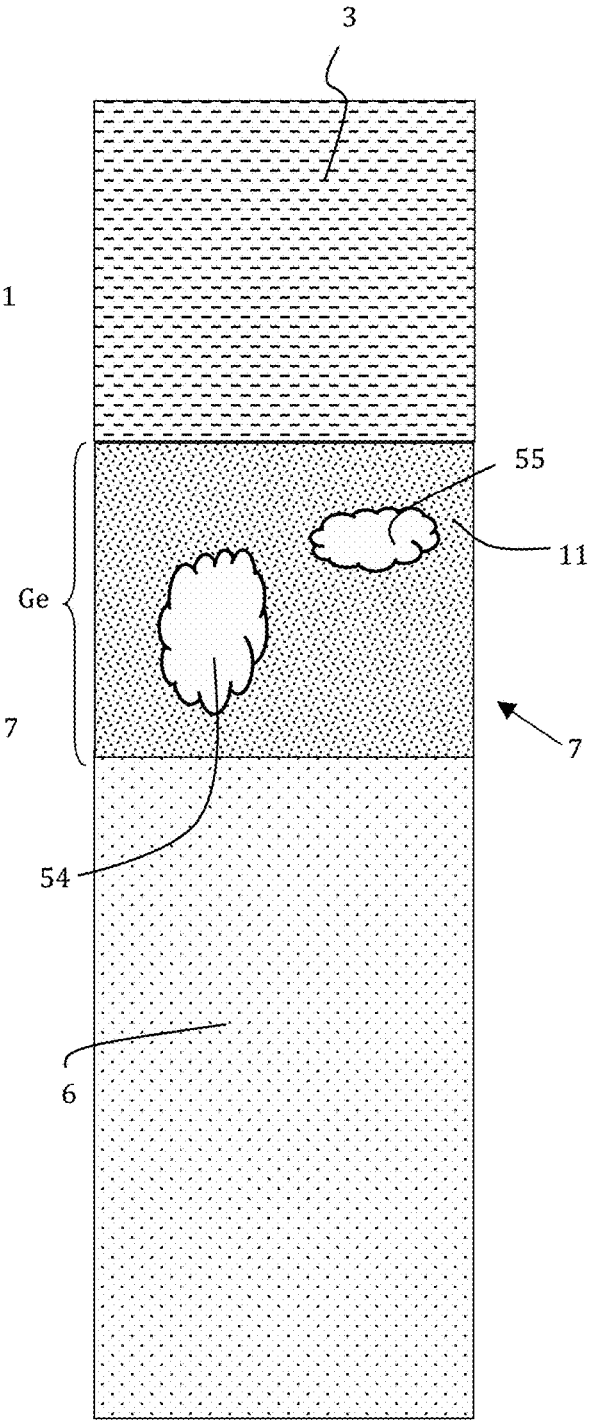

In FIGS. 7 and 8, another embodiment has been represented in which the cavities 51 to 55 sunk into the material 11 of the second layer 7 are obtained from injection of a gas into the material 11. For example, air can be injected into a mortar when it is hardening. Cavities 51 to 55 can also be created by adding a gas-generating compound to the material 11. When the binder of the material 11 is cement, the gas-generating compound reacts with the cement to produce a gas release which forms the cavities 51 to 55. The gas-generating compound suitable for cement can for example be an aluminium or zinc powder, or oxygen peroxide, or calcium carbide. The gases which form cause swelling of the material 11 to create the cavities 51 to 55.

Each cavity 51 to 55 enables the material 11 to be accommodated in the cavity 51 to 55 when convergence of the ground 3 takes place. An initial state in which the ground 3 is in contact with the second layer 7 of the construction elements 5 before convergence has been represented in FIG. 7. In the initial state, the cavities 51 to 55 occupy an initial volume in the material 11, and the second layer 7 has an initial thickness Gi. When the ground 3 converges, as illustrated in FIG. 8, the compressible second layer 7 deforms and enables displacement of the ground 3 towards the centre of the tunnel 1. The material 11 fills the cavities 51 to 53 until a state of equilibrium is reached in which the ground 3 is at an equilibrium distance Ge from the outer surface of the first layer 6. The equilibrium distance Ge is smaller than the initial distance Gi. The compressive strength of the second layer 7 is lower than the convergence pressure of the ground so as to allow filling of the cavities 51 to 55 of the material. Cavities which still exist after the state of equilibrium have been represented by the reference numerals 54 and 55. In other words, the second layer 7 absorbs the movements of the ground 3 without damaging the tunnel 1.

The second layer 7 can comprise different combinations between the various above-mentioned elements sunk into the material 11, i.e. cavities 51 to 55 obtained from injection of a gas into the material, and/or devices 8 having a closed free space 10, and/or pieces 40 having a porous body.

FIGS. 9 to 11 illustrate an embodiment of the devices 8 the body 9 of which delineates at least one closed free space 10. Preferentially, the devices 8 have a solid body 9 made from ceramic. Ceramic is suitable for making these devices 8, as it is malleable before a firing step so as to be able to form the closed free space 10 in the device 8, and as it becomes solid after firing. The solid body 9 of the device 8 is in particular impermeable to liquids, for example to the pasty mortar before hardening and also to hardened mortar. For example, the body 9 of the device 8 extends along a longitudinal axis A of the device 8 and comprises two closed ends 13, 14. The closed ends 13, 14 can each have a linear shape. In a first embodiment as illustrated in FIGS. 9 and 10, the ends 13, 14 are parallel to one another. As a variant, the ends 13, 14 can be perpendicular to another. For example, the body 9 of the device 8 is of cylindrical shape. What is meant by a cylinder is a solid limited by a cylindrical surface generated by a straight line, noted generatrix, passing through a closed flat curve, noted directrix, and two parallel planes cutting the generatrices. In particular, the body 9 can be in the form of a tube. The device 8 can also comprise several cavities communicating with one another or not. Advantageously the closed cavities 10 of the devices 8 prevent them from being imbricated in one another, whatever their size and shape.

In FIGS. 12 to 16, the main steps of an embodiment of a construction method of a construction element 5 as defined in the foregoing have been represented. In general manner, the construction element 5 is produced by performing the following steps:

- the incompressible first layer 6 is made from concrete; and
- the compressible second layer 7 is made from a material 11 comprising granulates aggregated by a binder, and cavities 51 to 55 sunk into the material.

Figure 12:
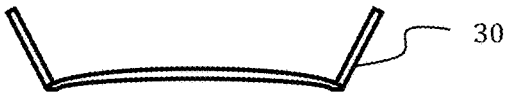
FIGS. 12 to 16 schematically illustrate the main steps of an embodiment of a construction method of a construction element.
Figure 13:
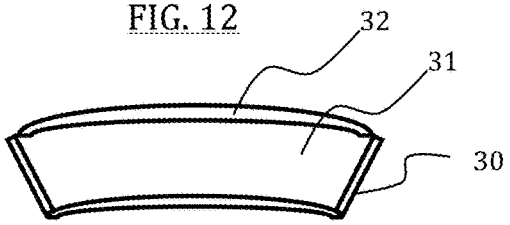
Figure 14:
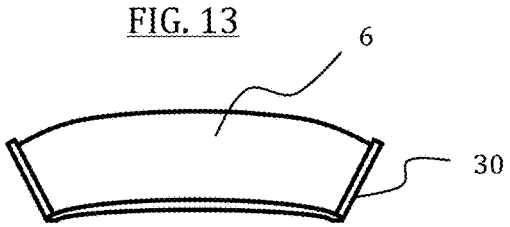
Figure 15:
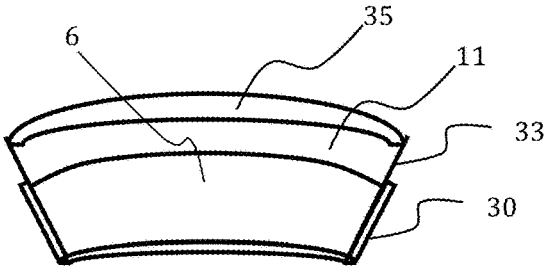

For example, to produce the concrete first layer 6, an open and curved parallelepipedic formwork 30 is used to achieve a voussoir shape, as illustrated in FIG. 12. As a variant, the formwork 30 is open and not curved to make tunnel sections of various shapes, for example U-shaped or ovoid. Then liquid concrete 31 is poured into the formwork 30, as illustrated in FIG. 13. Metal bars can also be added to the liquid concrete 31 to obtain an incompressible first layer of reinforced concrete. Then a first template 32 is used, placed on the surface of the concrete 31 and moved along the surface in order to form a curved outer surface. The concrete 31 is allowed to set, either completely in which case the concrete has totally hardened, or partially in which case the concrete has not totally hardened but has sufficiently hardened at the surface to keep the curvature given by the first template 32. Then the first template 32 is removed and a first layer 6 is thus obtained having a curved base and outer surface, as illustrated in FIG. 14. Formwork elements 33 are further fixed onto the edges of the formwork 30 to increase the height of the formwork 30 and to be able to form the second layer 7, as illustrated in FIG. 15. Then the material 11 is poured into the formwork 30, and more particularly onto the outer surface of the first layer 6. According to one embodiment, when the material 11 is poured, the concrete of the first layer 6 has not completely hardened. In this embodiment, adhesion of the material to the outer surface of the first layer 6 which has not yet completely hardened is enhanced. As a variant, it is possible to wait until the concrete has completely hardened and then pour the material 11. In particular, the material 11 is poured in pasty state before it hardens. Preferably, the binder of the material 11 is cement to obtain a mortar as material 11. Devices 8 each having a solid body 9 delineating at least one closed cavity 10 can subsequently be mixed with the material 11 in pasty state. Pieces 40 having a porous solid body can also be mixed with the material 11 in pasty state. A gas-generating compound can also be mixed with the material 11 in pasty state. A gas can also be injected into the material 11 in pasty state by means of a gas injector. A material is thus obtained in which cavities 51 to 55 are sunk.

Figure 16:
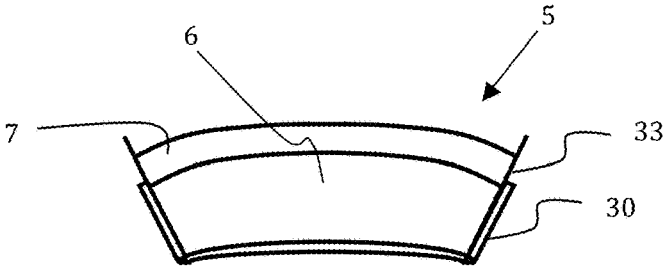

Then the material 11 is left to harden to secure the compressible second layer 7 to the first layer 6. Then a second template 35 is used which is placed and moved on the surface of the material 11 in order to form a curved outer surface on the second layer 7, as illustrated in FIG. 15. The material 11 is then left to harden to secure the second layer 7 to the first layer 6. Then the second template 35 is removed and a monoblock prefabricated element 5 surrounded by the formwork 30 is obtained, as illustrated in FIG. 16. Then the formwork 30 and formwork elements 33 are removed to obtain the monoblock prefabricated construction element 5, as illustrated in FIG. 2.

Figure 17:
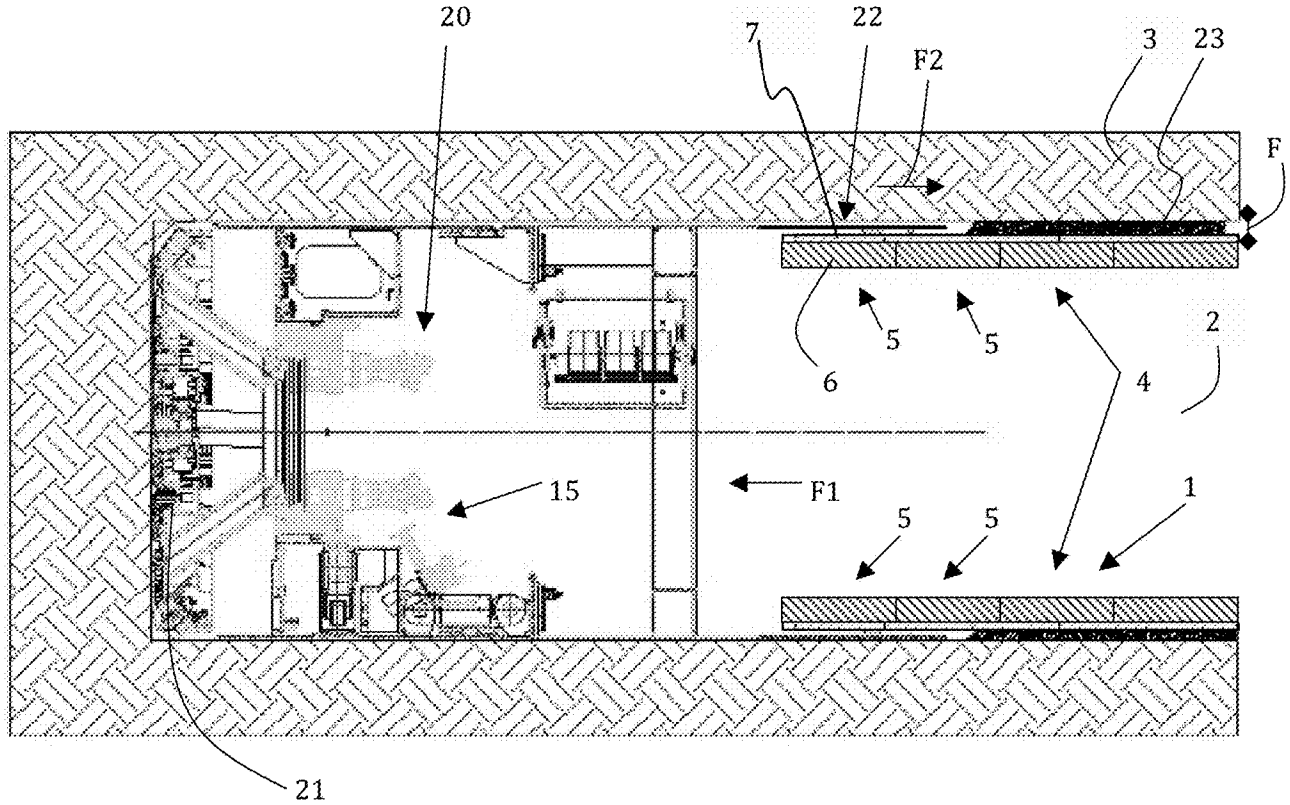
FIG. 17 schematically illustrates a cross-sectional view of a tunnel boring machine creating the tunnel of FIG. 1.

An embodiment of construction of the tunnel 1 described in the foregoing in FIG. 1 has been represented in FIG. 17. According to this embodiment, a tunnel boring machine 15 excavates the cavity 2 in the ground 3 in the direction F1. The front of the tunnel boring machine 20 is equipped with means 21 to break up the rock of the ground 3 and comprises rock extraction means, not represented for the sake of simplification. A part of the tunnel boring machine 15 performs placing of the construction elements 5 as the tunnel boring machine 15 progressively advances in the direction F1. The tunnel boring machine 15 further comprises injection means 22 to inject a filling product 23, for example mortal or gravel, to fill the free space F delineated between the construction elements 5 and the inner wall of the cavity 2 formed by progression of the tunnel boring machine 15. The arrow, indicated by reference numeral F2, illustrates the path taken by the filling product 23 when it is injected. Injection of the filling product 23 enables a filling layer to be formed to occupy the free space F between the construction elements 5 and the ground 3.

In general manner, the method for constructing the tunnel comprises the following steps:

- forming the cavity 2 in the ground 3 by means of the tunnel boring machine 15;
- forming sections 4 of the tunnel 1 situated inside the cavity 2, at least one section 4 being made from at least one construction element 5, as defined in the foregoing, as the tunnel boring machine 15 progressively advances.

More particularly, when a section 4 of the tunnel 1 is constructed, a free space F delineated between the outer wall of the tunnel 1 and the inner wall of the cavity 2 is preserved to place the construction elements 5 in order to form the section 4 of the tunnel 1. Then the free space F is filled with the filling product 23.

The construction element that has been described in the foregoing facilitates creation of the tunnel while at the same time guaranteeing damping of the convergence of the ground in which the tunnel is situated. It further provides a better mastery of the construction method of the tunnel. Such a construction element enables the thickness of a conventional voussoir to be reduced, which greatly reduces the quantity of concrete necessary to construct the tunnel. Such a construction element is simple to produce, easily transportable, and guarantees preservation of a compressible layer securedly united to the incompressible layer for transportation and integration of the construction element in a tunnel.

The invention claimed is:

1. A construction element for creation of a tunnel, comprising:

an incompressible first layer made from concrete; and a compressible second layer securedly united to the first layer to form a monoblock prefabricated construction element configured to be integrated in a section of the tunnel, wherein the second layer comprises:

a material comprising granulates aggregated by a binder, cavities sunk into the material, and a plurality of devices sunk into the material, each device having a solid body delineating at least one closed free space.

2. The construction element according to claim 1, wherein the binder comprises a cement.

3. The construction element according to claim 1, wherein the solid body of the devices is made from ceramic.

4. The construction element according to claim 1, wherein the solid body of the devices is made from plastic.

5. The construction element according to claim 1, wherein the second layer comprises a plurality of pieces sunk into the material, each piece having a porous solid body provided with several pass-through holes and several closed free spaces.

6. The construction element according to claim 1, wherein the second layer comprises a gas-generating compound inside the material forming the cavities.

7. A tunnel situated inside the cavity excavated in a plot of ground, at least one section of the tunnel being constructed from at least one two-layer construction element according to claim 1.

8. A method for constructing a tunnel comprising:

forming a cavity in a ground by means of a tunnel boring machine; and forming sections of the tunnel situated inside the cavity, at least one section being made from at least one two-layer construction element according to claim 1 as the tunnel boring machine progressively advances.

9. A method for manufacturing a construction element for creating a tunnel, comprising:

making an incompressible first layer of concrete;

making a compressible second layer securedly united to the first layer to form a monoblock prefabricated construction element configured to be integrated in a section of the tunnel;

the second layer being made from a material comprising granulates aggregated by a binder, and cavities sunk into the material, and wherein devices each having a solid body delineating at least one closed free space are sunk into the material.

10. The method according to claim 9, wherein the cavities are made by injecting a gas into the material.

* * * * *